US005326328A

United States Patent [19]

Robinson

[11] Patent Number: 5,326,328

[45] Date of Patent: Jul. 5, 1994

[54] PLAY STRUCTURES

[76] Inventor: S. Eric Robinson, P.O. Box 10, Shallow Lake, Ontario, Canada, N0H 2K0

[21] Appl. No.: 866,990

[22] Filed: Apr. 10, 1992

[51] Int. Cl.[5] ..... A63G 31/00

[52] U.S. Cl. ..... 472/136; 472/116; 482/35; 52/80.1

[58] Field of Search ..... 472/136, 116; 52/40, 52/80, 81, 236.2; 482/35, 36; 446/476, 231

[56] References Cited

U.S. PATENT DOCUMENTS

| | | | |
|---|---|---|---|
| 2,199,915 | 5/1940 | Howard | 472/126 |
| 2,499,478 | 3/1950 | Feser | 52/236.2 |
| 3,388,513 | 6/1968 | Bauer | 52/236.2 |
| 3,394,491 | 7/1968 | Valentine | 446/231 |
| 3,455,069 | 7/1969 | Keyes | 52/80 |
| 4,612,741 | 9/1986 | Jacobson | 52/236.2 |
| 4,893,807 | 1/1990 | Ahrens | 472/116 |

*Primary Examiner*—Carl D. Friedman
*Assistant Examiner*—Kien Nguyen
*Attorney, Agent, or Firm*—R. Craig Armstrong

[57] ABSTRACT

A plastic building element is described which permits a variety of play structures to be assembled. The main building element is a dish-shaped molded plastic part, having a bottom, integral lower side walls projecting generally upwardly from the outer periphery of the bottom to define a lower portion of one nominal diameter, integral generally horizontal portions projecting outwardly from the top of the lower side walls, and integral upper side walls projecting generally upwardly from the outer periphery of the horizontal portion to define an upper portion having a substantially larger nominal diameter. Preferably, the side walls are defined by a number of generally rectangular panels defining a polygonal shape for the building element as viewed in horizontal section. In the preferred embodiment, the structure is hexagonal. The building element can be used in its simplest application as a children's sandbox, or assembled to define play cavities in the form of more elaborate structures such as a "spaceship" or a "gumball machine".

17 Claims, 9 Drawing Sheets

PLAY STRUCTURES

BACKGROUND OF THE INVENTION

This invention relates to play structures, and particularly to such structures which provide a semi-enclosed play area for children.

Many forms of play structures are of course already known. For example, tree houses and children's play houses of various designs are known, most being made from wood, either custom made or else fabricated from kits. Some plastic structures are also known. Play houses constructed from rotationally molded plastic panels which are fastened together are marketed by Fisher-Price, for example.

SUMMARY OF THE INVENTION

It is an object of the invention to provide a plastic building element which permits a variety of novel play structures to be assembled. In one embodiment, for example, as shown in FIG. 1, a "spaceship" or "lunar lander" structure can be assembled. In another embodiment, for example, as shown in FIG. 14, a "gumball machine" can be assembled. The former is primarily intended for use in the residential backyard market; the latter is primarily intended for use in commercial or institutional settings such as shopping malls, day care centres, schools, etc., and may be partially filled with plastic balls or the like if desired.

In the invention, the main building element is a dish-shaped molded plastic part, having a bottom, integral lower side walls projecting generally upwardly from the outer periphery of the bottom to define a lower portion of one nominal diameter, integral generally horizontal portions projecting outwardly from the top of the lower side walls, and integral upper side walls projecting generally upwardly from the outer periphery of the horizontal portion to define an upper portion having a substantially larger nominal diameter.

Preferably, the side walls are defined by a number of generally rectangular panels defining a polygonal shape for the building element as viewed in horizontal section. In the preferred embodiment, the structure is hexagonal.

The building element, in its simplest application, could be used as a children's sandbox, whether dug into the ground or placed on the surface with suitable supports. However, its primary intended application is as a component of the "spaceship" or "gumball machine" structures described in greater detail below.

Further features of the invention will be described or will become apparent in the course of the following detailed description.

BRIEF DESCRIPTION OF THE DRAWINGS

Embodiments of the invention will now be described, by way of example only, with reference to the accompanying drawings, in which.

DETAILED DESCRIPTION OF THE PREFERRED EMBODIMENT

Figure 1:
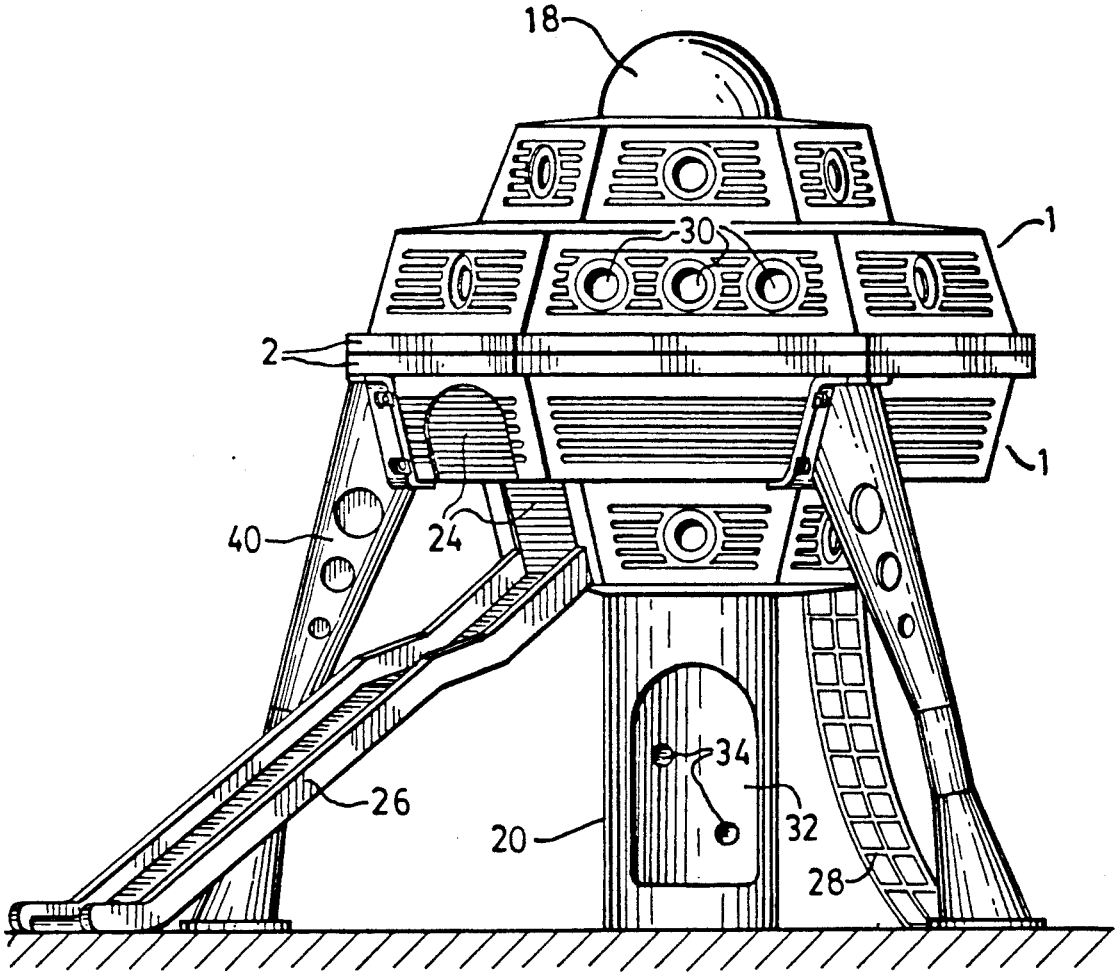
FIG. 1 is an elevation view of a "spaceship" embodiment.
Figure 2:
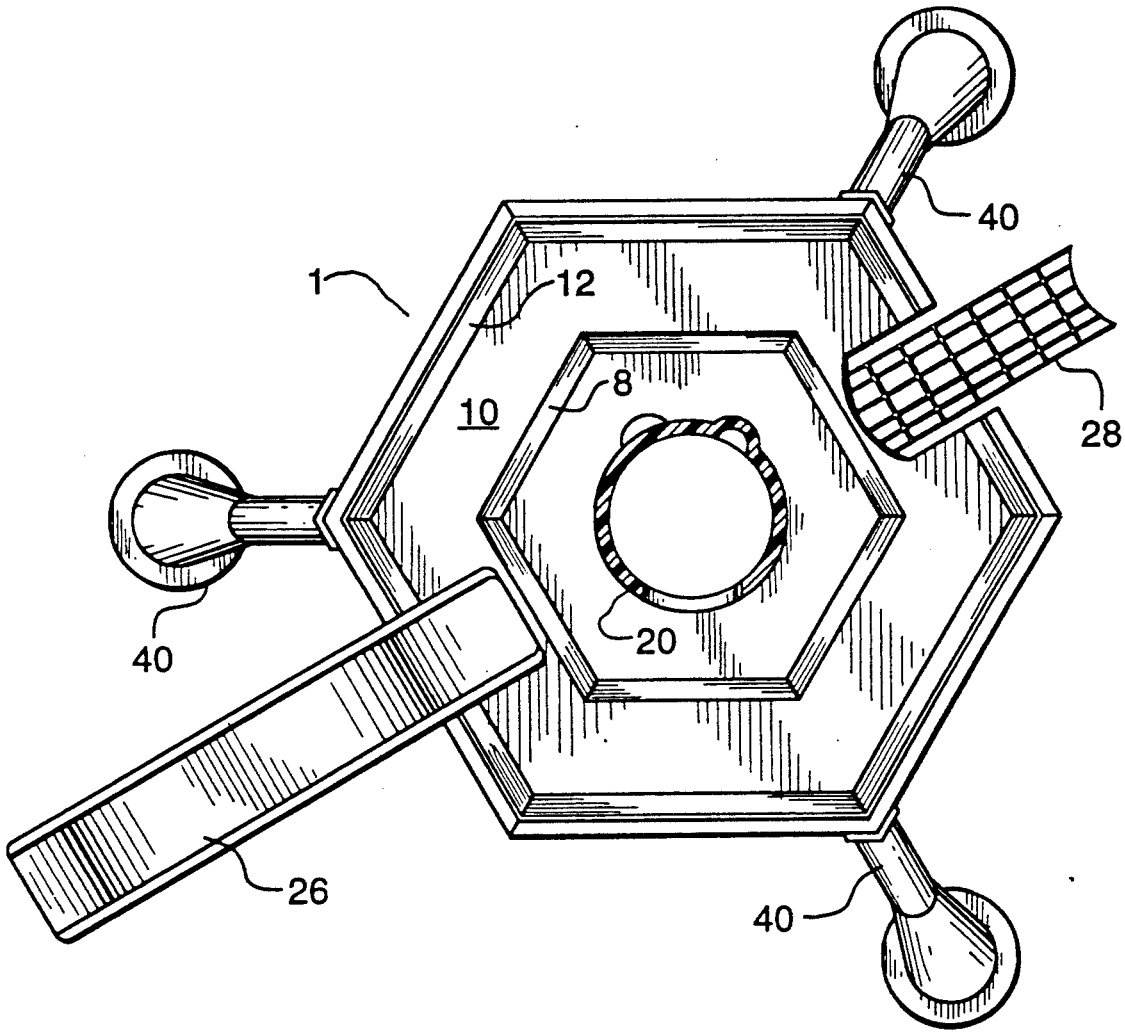
FIG. 2 is a top view of the "spaceship" embodiment, with the upper half removed to expose the interior.
Figure 4:
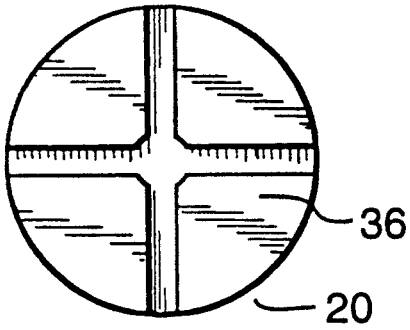
FIG. 4 is a top view of the climbing tube.
Figure 5:
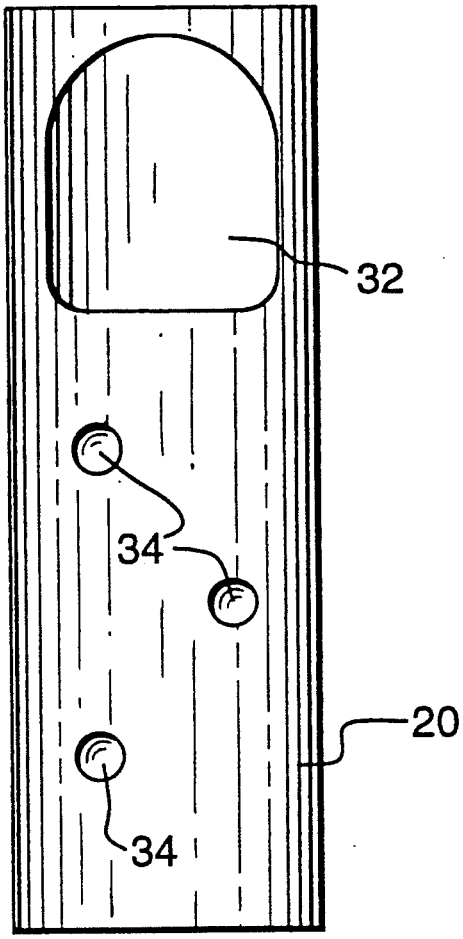
FIG. 5 is an elevation view of the opposite side of the climbing tube.
Figure 3:
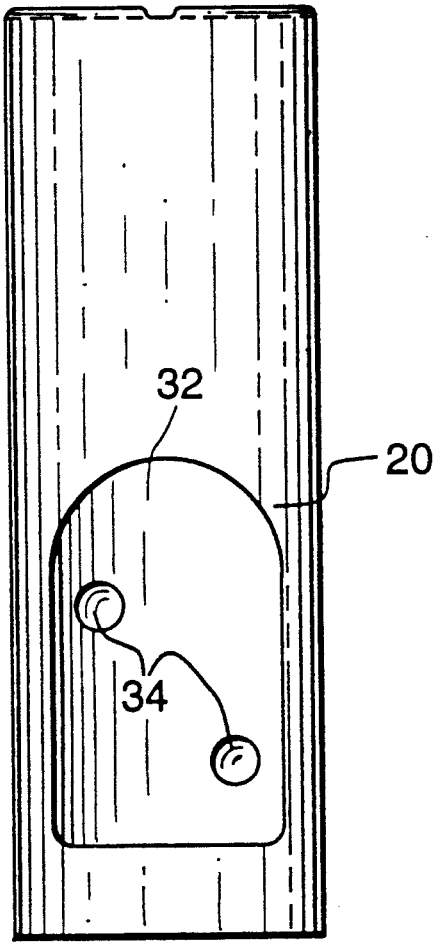
FIG. 3 is an elevation view of one side of the climbing tube.
Figure 6:
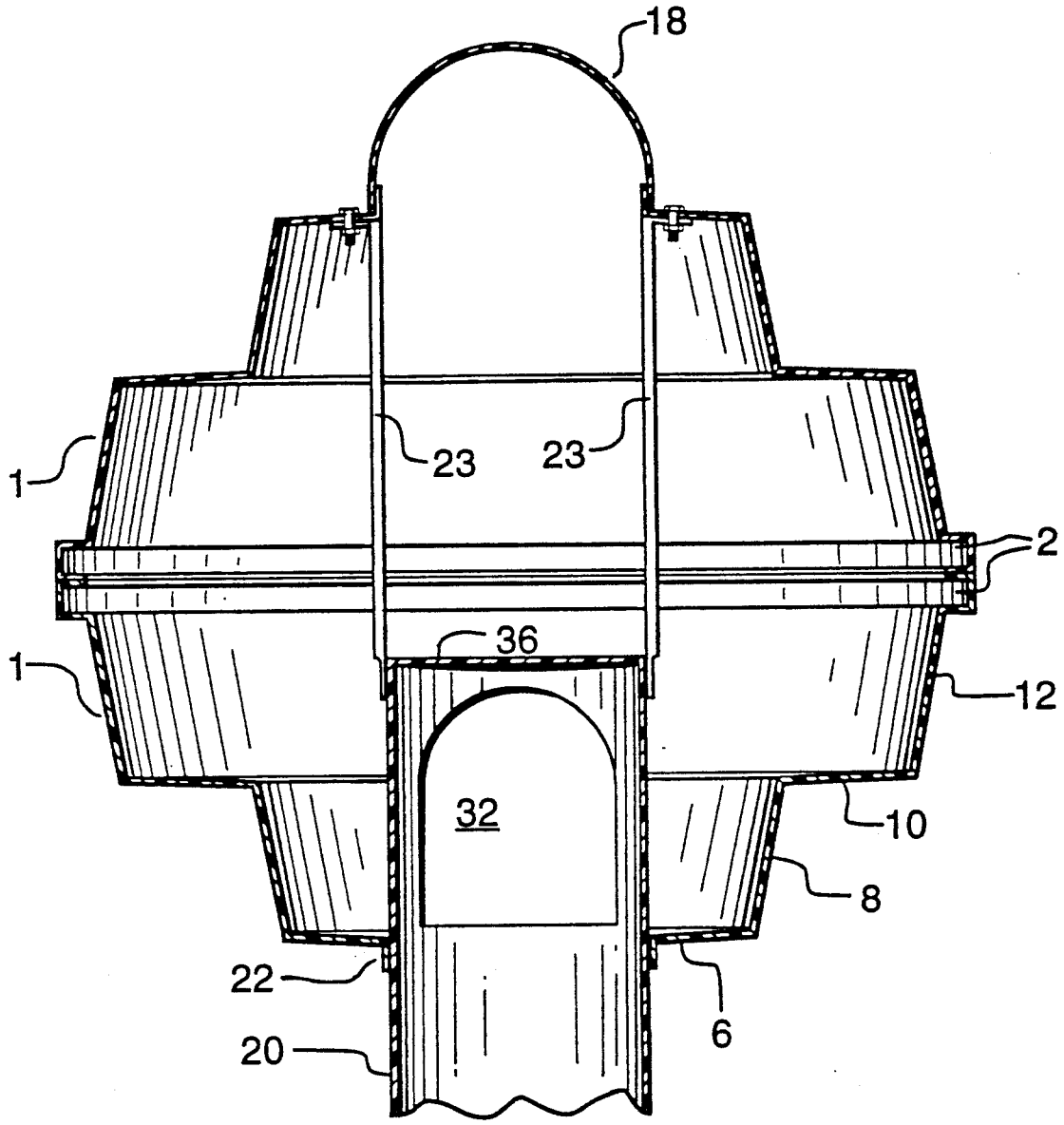
FIG. 6 is another side cross-sectional view of the "spaceship"
Figure 7:
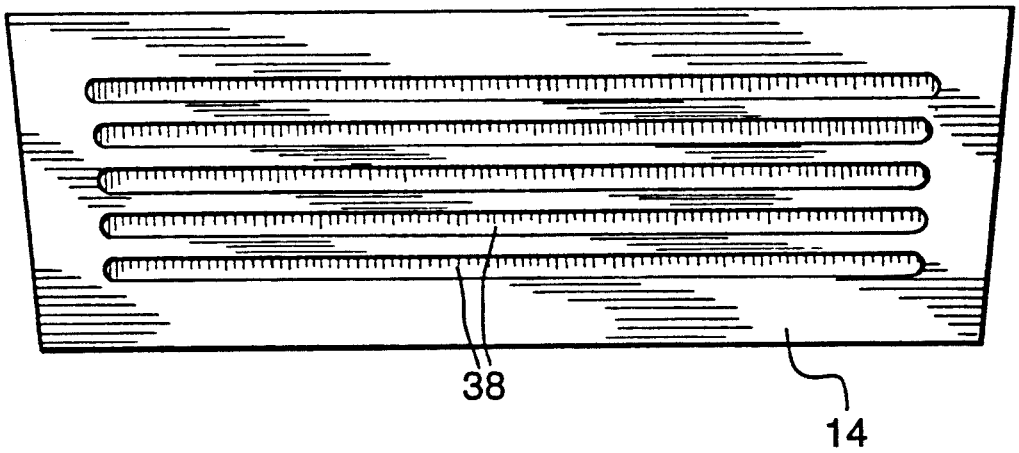
FIG. 7 is an elevation view of one of the side walls on the larger diameter portion of the building element.
Figure 8:
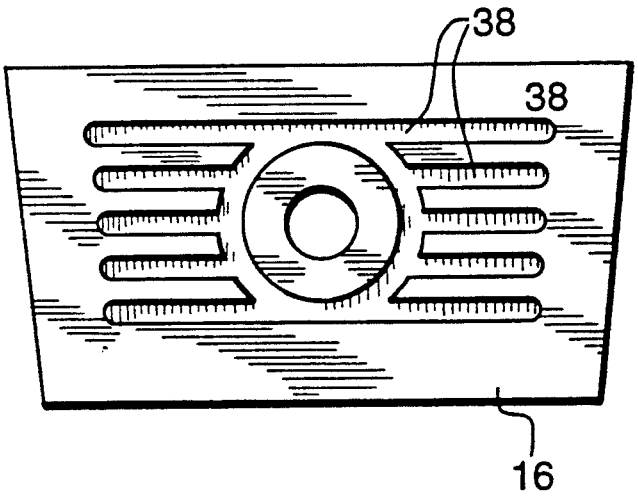
FIG. 8 is an elevation view of one of the side walls on the smaller diameter portion of the building element.
Figure 9:
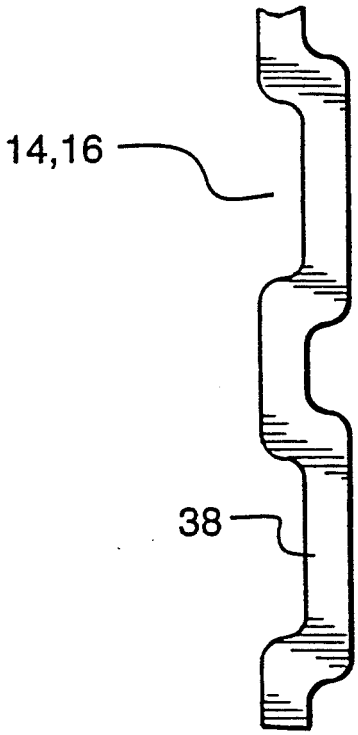
FIG. 9 is a cross-section of one of the ribbed areas of the side walls.

FIG. 1 shows a "spaceship" or "lunar lander" play structure assembled according to-the invention, using two of the building elements 1, one inverted over the other, and bolted together at a flange 2. For convenience, these will be referred to as the upper and lower shells. This embodiment is primarily intended for use in the residential backyard market.

The main building element 1 is a dish-shaped molded plastic part, having a bottom 6, integral lower side walls 8 projecting generally upwardly from the outer periphery of the bottom to define a lower portion of one nominal diameter, integral generally horizontal portions 10 projecting outwardly from the top of the lower side walls, and integral upper side walls 12 projecting generally upwardly from the outer periphery of the horizontal portion to define an upper portion having a substantially larger nominal diameter.

In the preferred embodiment, the structure is hexagonal, the upper and lower side walls being defined by upper and lower rectangular panels 14 and 16 respectively.

The building element 1 is produced by rotational molding. Sufficient plastic is placed in the mold to provide a wall thickness of approximately ¼ inch. The area of the mold at the top of the dish shape is insulated so that no plastic wall forms there, i.e. so that the top of the dish shape is open. In the bottom of the shape, a circular opening is cut for a transparent dome le in the case of the upper shell and for a climbing tube 20 in the case of the lower shell. A flange 22 is formed in the building element at that location, for bolting of the dome or tube. Additional openings are cut in the side walls of the lower shell for two doorways 24, one for a slide 26 and one for a rope ladder 28, both of which are bolted to the lower shell. In the upper shell, a number of ventilation holes 30 are cut through the side walls to ensure that there is sufficient air flow inside the structure. The ventilation holes also serve as "lookout" or portholes for children playing inside the structure. The plastic which is cut from the building element for these various openings is recycled for future production.

The transparent dome 18 is a conventional part which bolts to the flange 22.

The climbing tube 20 is rotationally molded as a hollow cylinder, and then doors 32 and footsteps 34 are cut through the cylinder wall. In the preferred embodiment, there are two doors, namely one which is essentially at ground level, to enter the tube and climb up into the "spaceship", and one which is within the "spaceship". The tube is bolted to the flange 22, so that it lends structural support to the overall structure.

Two 1¼ inch diameter support tubes 23 are bolted to the climbing tube, one on either side thereof, and run from there up to the top of the upper shell, where they are also bolted. This provides additional support for the upper lid to reduce any likelihood of buckling should a child climb onto the outside of the lid.

As can be appreciated from the drawings, the shape of the building element is such that inside the "spaceship", the horizontal portions 10 can act as seating. By selecting the length of the climbing tube appropriately, the closed upper end 36 of the tube acts as a tabletop for children seated on the horizontal portions.

The side walls 8, 12 have reinforcement ribs 38 defined therein to ensure that the structure is sufficiently strong.

Figure 10:
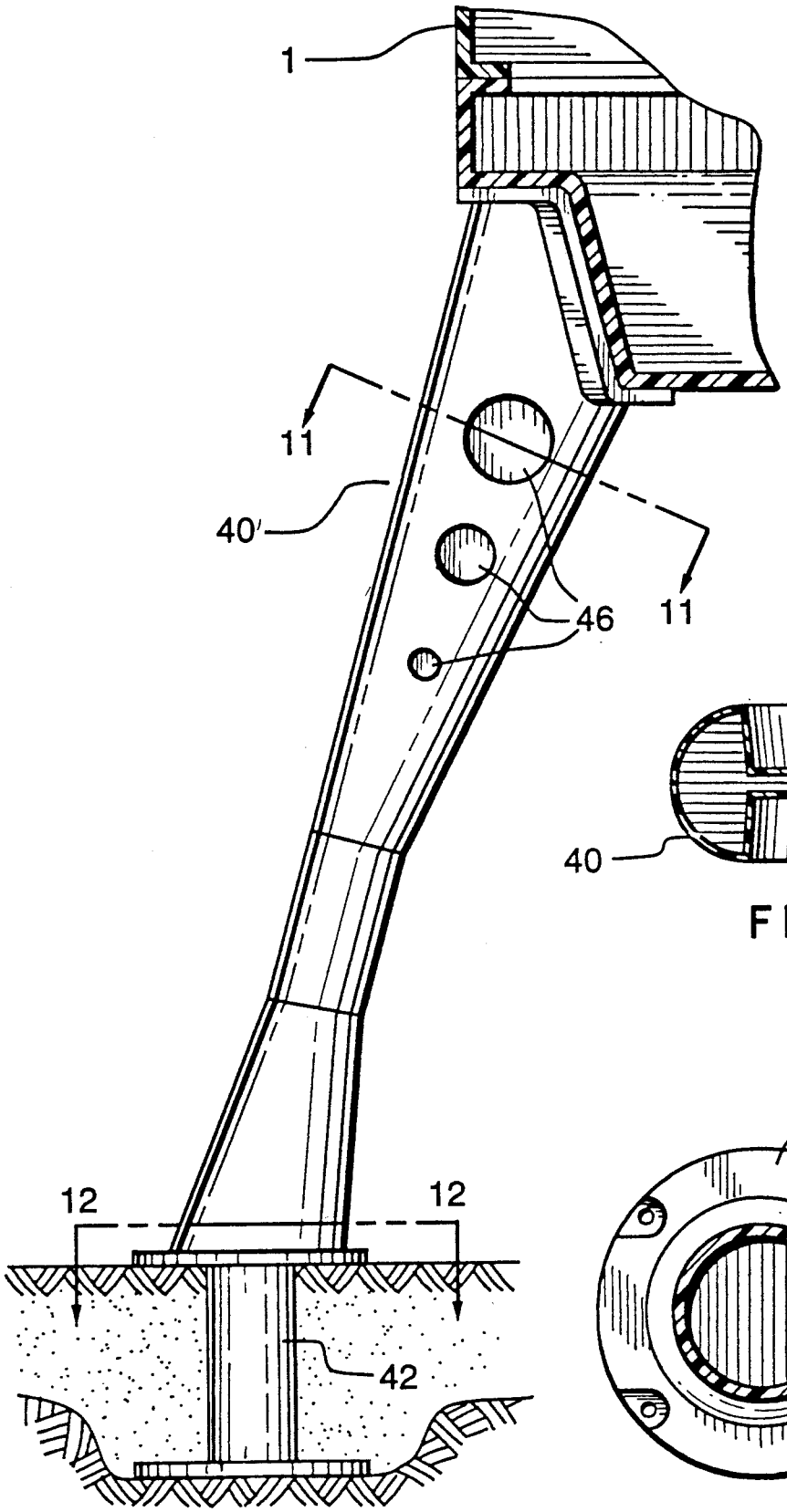
FIG. 10 is an elevation view of one of the legs which supports the "spaceship.
Figure 11:
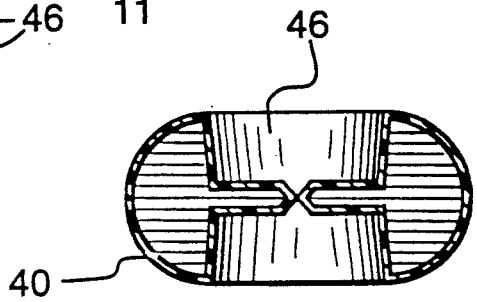
FIG. 11 is a cross-section of the leg at one of the indented areas.
Figure 12:
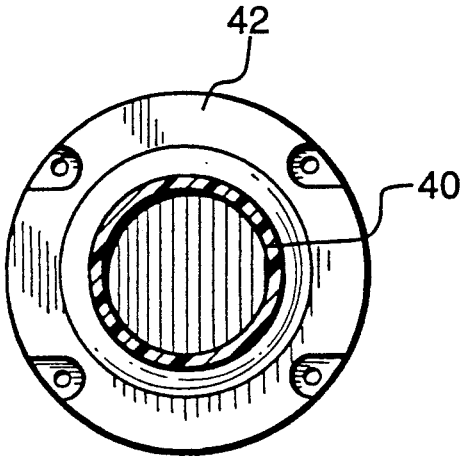
FIG. 12 is a cross-section of the leg just above the anchoring portion.

In addition to being somewhat supported by the climbing tube 20, the "spaceship" is supported by three rotationally molded plastic legs 40, spaced 120 degrees apart around the structure. As seen in FIG. 10, each leg has a lower anchoring portion 42 which is intended to be below ground level. Each leg has mounting flanges 44 at the upper end of the leg, for bolting to the lower shell. For additional strength as well as aesthetics, the upper section of each leg has several indented areas 46.

Figure 13:
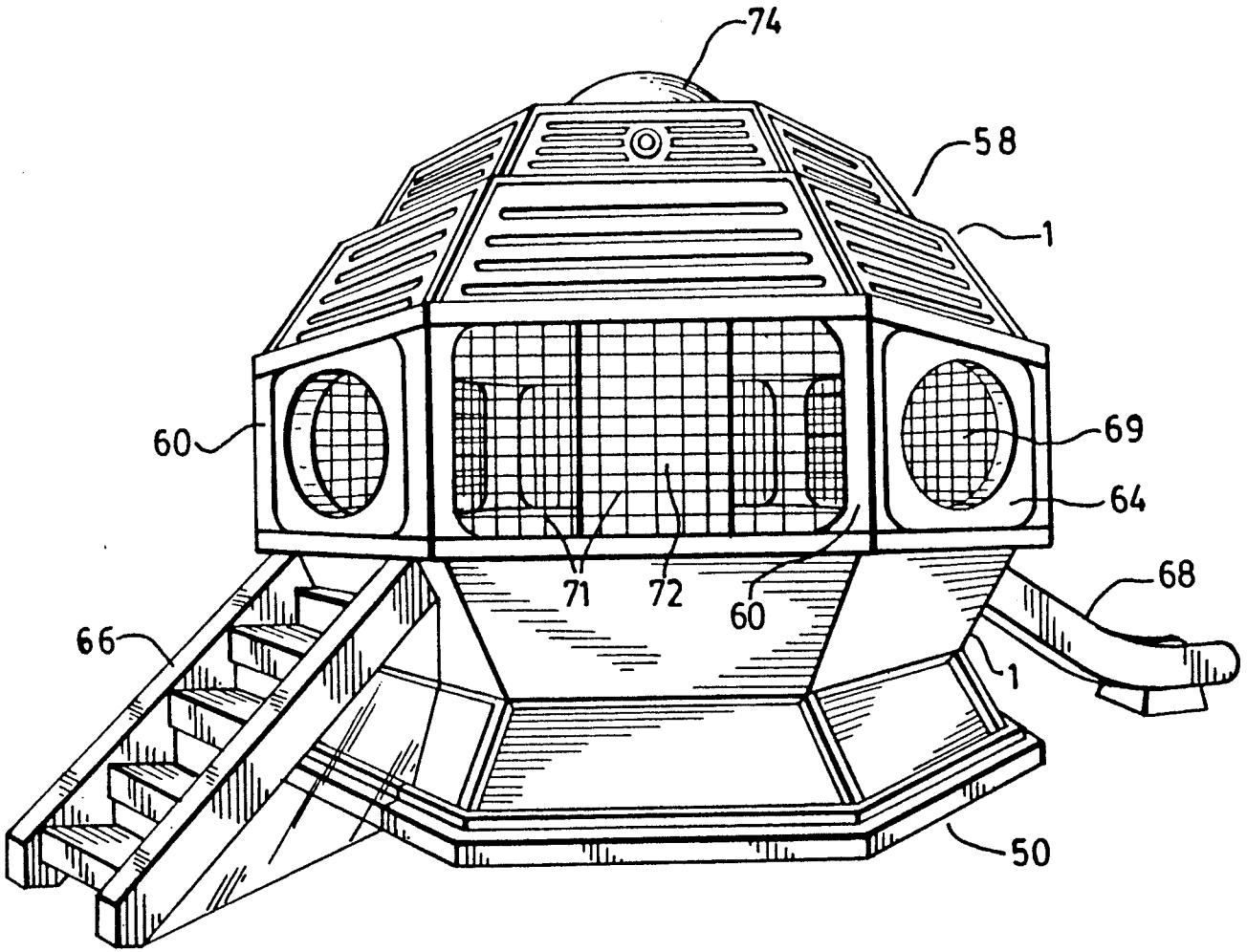
FIG. 13 is a perspective view of the "gumball machine" embodiment.
Figure 14:
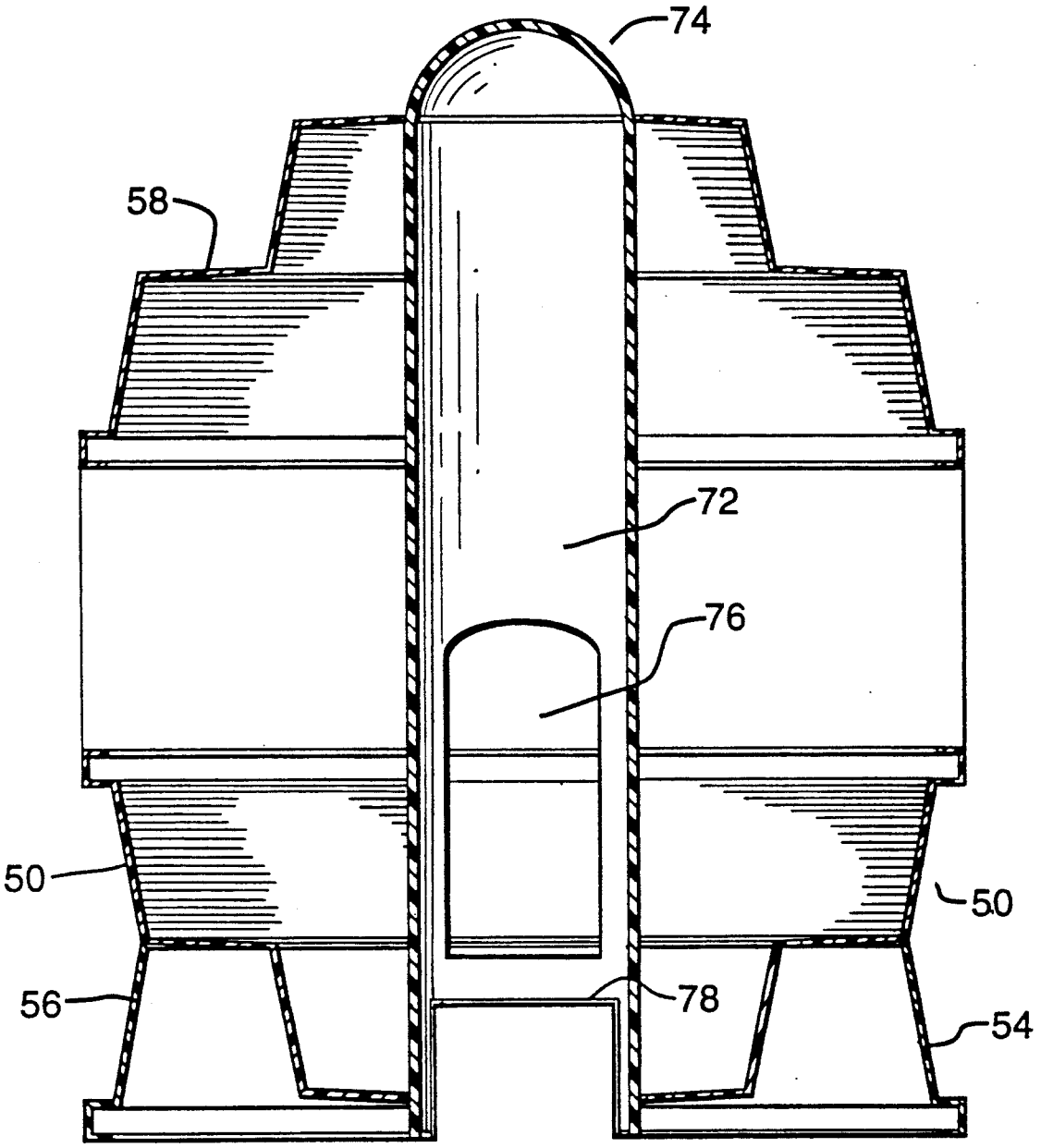
FIG. 14 is a cross-section of the "gumball machine" embodiment.
Figure 15:
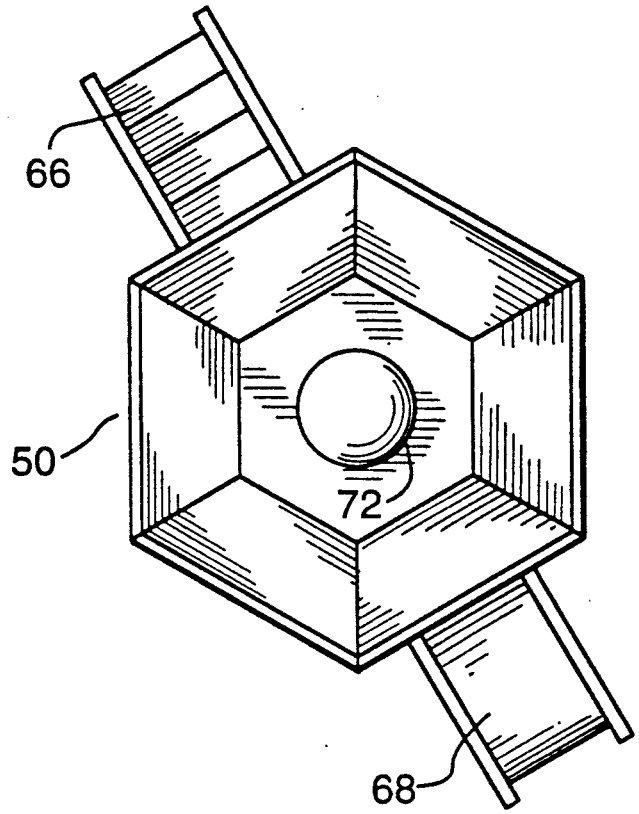
FIG. 15 is a top view of the "gumball machine" with the upper half removed to expose the interior.

In another embodiment, as shown in FIG. 13, a "gumball machine" can be assembled. This embodiment is primarily intended for use in commercial or institutional settings such as shopping malls, day care centres, schools, etc., and may be partially filled with plastic balls or the like if desired.

The same main building element 1 is used to produce the "gumball machine", although in this case three of the building elements are required. Two building elements (one and a half, actually) form the base 50. The first building element 52 sits with its smaller diameter portion on the ground; the second 54 has its smaller diameter portion cut off, leaving just the large diameter portion 56 which is used to support the first building element. A third building element forms the lid 58.

Figure 16:
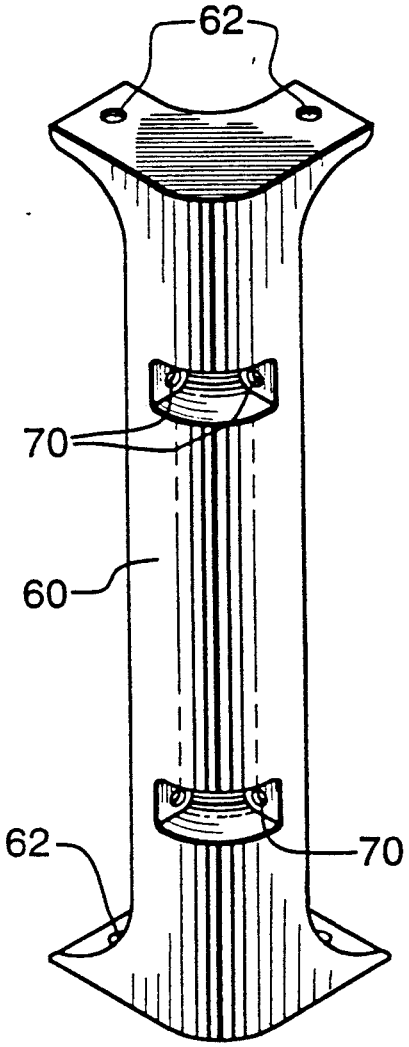
FIG. 16 is a perspective view of one of the corner posts in the "gumball machine" embodiment.

Separating the base from the lid are six corner posts 60. As seen in FIG. 16, each corner post has bolt holes 62 so that it can be bolted to the base and lid at four locations (two on top, two on the bottom). The corner posts result in six large openings between the posts. These openings may be used in a number of ways in accordance with the customer's preference. In the version shown in the drawings, three of the openings have panels 64 with circular holes. Two of the holes provide access to a staircase 66 and a slide 68 which are bolted to the base. The other hole has a transparent dome 69. The panels are held in place by bolts from the corner posts, each corner post being provided with suitable bolt holes 70, and may also be bolted to the base and lid if desired. The remaining three openings are covered by mesh 71.

A cylindrical tube 72 runs from the ground up to an upper transparent dome 74, to add play interest, and to add extra support for the lid. One or more openings 76 may be cut into the tube to allow access to its hollow interior, and footsteps may be provided to allow climbing up to the dome. A false bottom 78 may be desired to prevent a child from falling into the bottom of the tube.

While the present invention has been described and illustrated with respect to the preferred embodiment, it will be appreciated that other embodiments of the staircase may be readily made without departing from the scope or spirit of the invention, which is defined in the appended claims.

For example, although the preferred embodiment is hexagonal, it should be appreciated that the invention could be readily adapted to other shapes, including round, octagonal, pentagonal, square, or even rectangular. Certain shapes obviously will be less convenient to produce, and may require more or less bracing or other means to provide sufficient strength and stiffness, but such adaptations are clearly within the ordinary skill of those knowledgeable in the field, and are considered to be within the scope of the invention as defined in the claims which follow.

Furthermore, although the preferred embodiment is produced by rotational molding, which permits the flanges 2 to be directed inwardly, it would be possible to produce structures according to the invention via other processes such as vacuum molding. In that case, the flange would simply have to be directed outwardly so that the part could be removed from the mold.

What is claimed as the invention is:

1. A unitary molded plastic building element for large play structures, said building element comprising a dish shape oriented about a central vertical axis, said dish shape having:

a bottom;

integral lower side walls projecting generally upwardly from the outer periphery of said bottom and defining a lower portion of said dish shape of one nominal diameter;

integral generally horizontal portions projecting outwardly from the top of said lower side walls; and integral upper side walls projecting generally upwardly from the outer periphery of said horizontal portion and defining an upper portion of said dish shape having a substantially larger nominal diameter than the nominal diameter of said lower portion of said dish shape; said dish shape being sufficiently large to accommodate a child.

2. A building element as recited in claim 1, in which said dish shape is circular as viewed in horizontal cross section.

3. A building element as recited in claim 1, in which said side walls of said upper and lower portions comprise a plurality of generally rectangular panels defining a polygonal shape for the building element as viewed in horizontal cross section.

4. A building element as recited in claim 3, in which at least some of said generally rectangular panels have a plurality of reinforcing ribs.

5. A building element as recited in claim 1, in which said polygonal shape is a hexagon.

6. A building element as recited in claim 5, in which at least some of said generally rectangular panels have a plurality of reinforcing ribs.

7. A play structure comprising two building elements as recited in claim 1, the first said building element being oriented with its bottom down, and the second said building element being inverted and positioned above and against said first building element and being fastened thereto, thereby defining a play cavity between said elements, said play cavity being large enough to accommodate a child, at least one of said building elements having at least one access opening cut in a wall thereof to provide access to said play cavity.

8. A play structure as recited in claim 7, further comprising means for supporting said play structure above the ground, and a vertically oriented climbing tube positioned beneath said structure and extending from the ground and up into said play cavity through an opening provided in the bottom of said first building element, said climbing tube having at least one opening therein beneath said play structure and at least one opening therein within said play structure for entry and egress from said play structure.

9. A play structure as recited in claim 8, where said means for supporting said play structure comprises at least three legs evenly spaced around said play structure and secured thereto, each said leg comprising an elongated generally tubular shape having fastening flanges at the upper end thereof for fastening said leg to said play structure and having at the lower end thereof a ground-surface-engaging plate, an anchoring pillar portion extending downwardly into the ground from said ground-surface-engaging plate, and a horizontal anchoring plate at the bottom of said anchoring pillar.

10. A play structure as recited in claim 9, where said play structure is hexagonal, and where there are three said legs spaced 120° apart from each other around said play structure.

11. A play structure as recited in claim 10, in which said climbing tube has a closed upper end positioned within said play structure at a height which is usable as a table-top by a child sitting on said horizontal surface of said building element.

12. A play structure as recited in claim 9, in which said climbing tube has a closed upper end positioned within said play structure at a height which is usable as a table-top by a child sitting on said horizontal surface of said building element.

13. A play structure as recited in claim 8, in which said climbing tube has a closed upper end positioned within said play structure at a height which is usable as at able-top by a child sitting on said horizontal surface of said building element.

14. A play structure comprising two building elements as recited in claim 1, the first said building element being oriented with its bottom down, and the second said building element being inverted and positioned above said first building element, separated therefrom by a plurality of posts fastened to each of said building elements, thereby defining a play cavity between said elements.

15. A play structure as recited in claim 14, further comprising the large diameter and horizontal portions of an inverted building element positioned beneath said first building element for providing additional support for said play structure.

16. A play structure as recited in claim 15, where said play structure is hexagonal, and where there are six said posts, namely one at each corner of said hexagon.

17. A play structure as recited in claim 14, further comprising a cylindrical tube projecting from the ground, through the bottom of said first building element, up to the inverted bottom of said second building element, said cylindrical tube being fastened to both said building elements, thereby strengthening said play structure.

* * * * *